US005426280A

United States Patent [19]

Smith

[11] Patent Number: 5,426,280

[45] Date of Patent: Jun. 20, 1995

[54] COOKING DEVICE HAVING A SENSOR RESPONSIVE TO AN INDICIA FOR EXECUTING A COOKING PROGRAM

[75] Inventor: Harry F. Smith, Newtown, Conn.

[73] Assignee: Intellectual Property Development Associates of Connecticut, Inc., Trumbull, Conn.

[21] Appl. No.: 197,079

[22] Filed: Feb. 16, 1994

[51] Int. Cl.[6] ..... H05B 6/68

[52] U.S. Cl. ..... 219/506; 219/714; 219/720; 99/325

[58] Field of Search ..... 219/714, 720, 506, 702, 219/704; 99/325; 364/477

[56] References Cited

U.S. PATENT DOCUMENTS

| | | | |
|---|---|---|---|
| 4,323,773 | 4/1982 | Carpenter | 219/714 |
| 4,568,810 | 2/1986 | Carmean | 219/720 |
| 4,780,588 | 10/1988 | Edamura | 219/714 |
| 4,924,048 | 5/1990 | Bunce et al. | 219/714 |

*Primary Examiner*—Philip H. Leung

[57] ABSTRACT

A cooking device (10), such as a microwave oven, is provided with a sensor (16) that is responsive to an indicia (18) associated with a food that is to be heated or cooked. For example, the indicia may be a bar code (UPC barcode) that is provided as a part of the packaging of the food. In one embodiment of this invention the cooking device has a controller (14) that is responsive to the indicia being detected by the sensor for looking up in a memory (26) a stored cooking program that has one or more program steps. The controller is responsive to the cooking program to activate and operate a cooking chamber, such as a microwave oven compartment, in accordance with the program steps of the cooking program that is identified by the indicia. The cooking program steps can each include a predetermined cooking time, cooking temperature, and power level setting. A cooking program step can also be a message to an operator, for example a message that indicates that operator intervention is required before cooking can continue. The indicia can be used to identify a cooking program to be looked up. The indicia can also be used to convey cooking variables (time, temperature, etc.) and also constants, such as an identification of a prestored message to be displayed to the user. The indicia can also encode a specific and explicit set of cooking instructions for entry into and execution by the cooking device controller.

35 Claims, 2 Drawing Sheets

COOKING DEVICE HAVING A SENSOR RESPONSIVE TO AN INDICIA FOR EXECUTING A COOKING PROGRAM

FIELD OF THE INVENTION

This invention relates generally to methods and apparatus for cooking food.

BACKGROUND OF THE INVENTION

It is known to provide a cooking device, specifically a microwave oven, that is preprogrammed to heat or cook a predetermined type of food, such as popcorn. This device has a start button which, when depressed, causes the microwave oven to execute the predetermined cooking cycle. The food, popcorn in this case, is prepackaged in an amount that corresponds to the predetermined cooking time. This device is useful in establishments, such as bars, that provide a limited menu in that no programming of the microwave is required in order to prepare the food. This eliminates cooking time mistakes and food wastage.

While this device may be suitable for a narrow range of applications, the number of different types of foods that the establishment can offer is limited to only those that would be compatible with the one preprogrammed cooking cycle.

A problem that occurs in many home kitchens is a difficulty in properly programming the cooking device (microwave, oven, etc.) for a correct cooking time and temperature(s). This problem may be especially apparent in a household where adolescent and post-adolescent children are responsible for cooking in an unsupervised manner. That is, it is important that the child properly program the cooking time and temperature to avoid a possibility of fire and other hazards.

A further problem is presented when a person has difficulty in reading the cooking instructions that accompany a prepackaged food, either due to language differences or a physical impairment. This problem may be especially troublesome for many elderly persons, and in general for those persons with impaired vision.

It is therefore an object of this invention to provide an improved cooking apparatus that includes a sensor that is responsive to an indicia, such as a bar code that is placed on the packaging of a food, to control a cooking cycle in accordance with the indicia.

SUMMARY OF THE INVENTION

The foregoing and other problems are overcome and the object of the invention is realized by a cooking device that is constructed and operated in accordance with this invention. A cooking device, such as a microwave oven, is provided with a sensor that is responsive to an indicia that is provided with a food that is to be heated or cooked. For example, the indicia may be a bar code (UPC code) that is provided as a part of the packaging of the food.

In one embodiment of this invention a cooking device controller is responsive to the indicia being detected by the sensor for looking up a stored cooking program that has one or more program steps, The cooking device is responsive to the cooking program to activate and operate a cooking chamber, such as a microwave oven compartment, in accordance with the program steps of the cooking program that is identified by the indicia. The cooking program steps can each include a predetermined cooking time, cooking temperature, and power level setting. A cooking program step can also be a message to an operator, for example a message that indicates that operator intervention is required before cooking can continue.

The use of this invention does not require that the food or food packaging be modified in any way. That is, the same UPC barcode symbol that is scanned at the supermarket can be sensed and acted upon by the sensor and cooking device controller. However, it is also within the scope of this invention to employ an indicia that is dedicated to conveying food preparation instructions.

The indicia can be used to identify a cooking program to be looked up. The indicia can also be used to convey cooking variables (time, temperature, etc.) and also constants, such as an identification of a prestored message to be displayed to the user. The indicia can also encode a specific and explicit set of cooking instructions for entry into and execution by the cooking device controller.

In embodiments of this invention the cooking device relies only on the sensor for detecting the indicia and an operator activated device, such as a start button or switch, for initiating, executing, and possibly resuming, a predetermined cooking program.

In another embodiment of this invention the cooking device also includes a full complement of operator controls, such as a numeric keypad and function keys (power level, etc.), that enables conventional cooking to also be accomplished either separately from or in combination with the use of the sensor and indicia.

These and other features of the invention are more fully described below.

BRIEF DESCRIPTION OF THE DRAWINGS

The above set forth and other features of the invention are made more apparent in the ensuing Detailed Description of the Invention when read in conjunction with the attached Drawings, wherein.

FIGS. *2a–2d* illustrate examples of icons that are displayed as cooking instructions to a user.

DETAILED DESCRIPTION OF THE INVENTION

Figure 1:
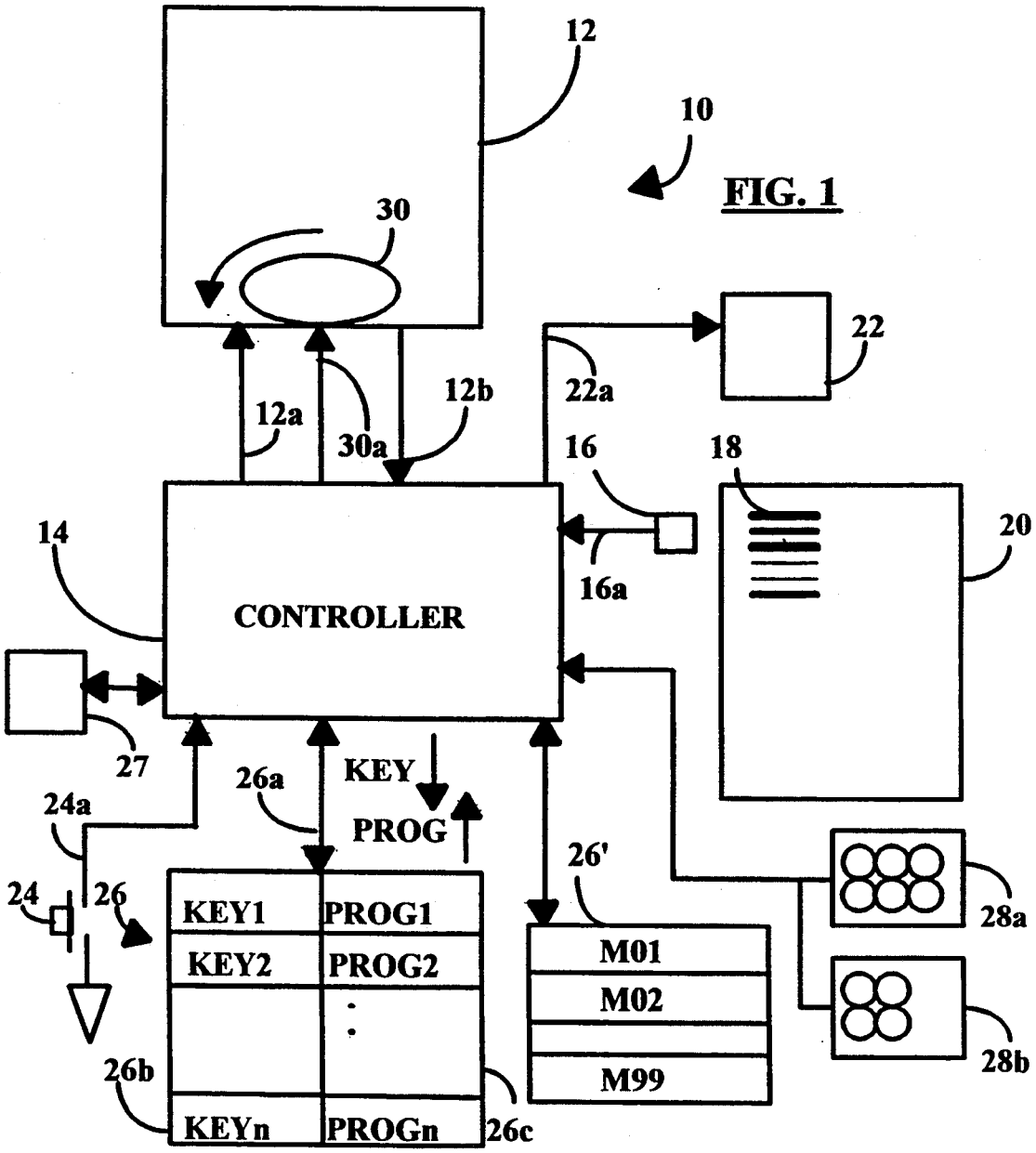
FIG. 1 is a block diagram of an embodiment of a cooking device that is constructed in accordance with this invention.
Figure 2A:
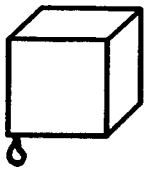
Figure 2B:
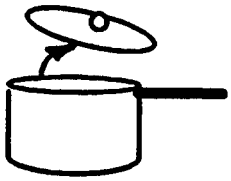
Figure 2C:
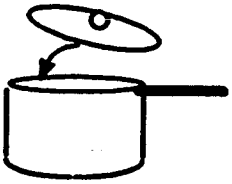
Figure 2D:
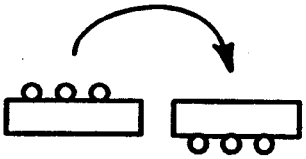

FIG. 1 is a block diagram of an embodiment of a cooking device 10 that is constructed in accordance with this invention.

As employed herein a cooking device is intended to encompass a device that heats a food, or foodstuff, so as to convert the food from a raw or partially raw state to a cooked or edible state. A cooking device is also intended to encompass a device that heats a precooked or partially cooked food. A cooking device is also intended to encompass a device that thaws a frozen food. The food can be in a liquid, semi-liquid or solid state.

The system 10 includes a cooking chamber 12 which heats an enclosed food with electromagnetic or with radiant energy. As such, and by example, the cooking chamber may be a part of a microwave oven, a gas oven, a toaster oven, or an electric oven. A controller 14, embodied within a microprocessor or a microcontroller, either custom or standard, is connected to the cooking chamber 12 by a control signal line 12*a*. The control signal line 12*a*, when energized by the controller 14, causes the cooking chamber 12 to heat a material (food) that is placed within. Signal lines **12*b* are output to the controller 14** and convey, by example, the output of a thermostat and/or the output of a sensor that indicates the state of a cooking chamber door (open/-closed).

In accordance with this invention the system 10 includes a sensor 16 that is responsive to an indicia 18, such as a bar code, that is disposed upon a substrate 20. The substrate 20 may be a portion of the packaging of the food to be heated. The indicia 18 may be a conventional UPC bar code that identifies the food or food product that is associated with the packaging. In other embodiments of the invention the indicia 18 may be specially provided and dedicated primarily to conveying cooking instructions or a cooking program for an associated food. The indicia 18 is a predetermined pattern comprised of ink, magnetic ink, punched out holes, printed characters, or any suitable medium that is capable of generating a detectable signal at the output of the sensor 16. For some embodiments of this invention the sensor 16 may also include a device, such as a LED or a laser diode, for illuminating the indicia 18. The sensor 16 may be a part of an optical character recognition (OCR) function that is embodied within the controller 14, or that is provided separately therefrom. In general, the sensor 16 is responsive to an optical contrast, a physical contrast, or a magnetic contrast between the indicia 18 and the substrate 20 as the indicia 18 is translated through a detection region of the sensor 16.

Coupled to an output of the controller 14, via a conductor **22*a*, is an indicator 22 (visual, audio, audio/-visual) that is used at least to indicate to the user that the indicia 18 has been recognized by the controller 14. For example, the indicator 22** may be an LED or a LCD display whereby a multi-character cooking instruction and/or status message and/or a graphical pattern, such as an icon, is displayed to the operator.

In some embodiments of this invention it may be desirable to provide a voice synthesis device as a part of the indicator 22 to provide an aural output that corresponds to the cooking instruction or message.

At least one switch 24, preferably a momentary type, is connected via a conductor **24*a* to the controller 14. The switch 24** is activated by the user and functions as a start switch whereby the user initiates a cooking cycle or restarts a temporarily halted cooking cycle.

A memory 26 is bidirectionally coupled to the controller 14 through a bus **26*a*. The memory 26 may be internal to the controller 14 or may be a separate component. The memory 26 stores a plurality of codes or keys ($K_1$–$K_n$) 26*b*, each of which has an associated cooking program ($PROG_1$–$PROG_n$) 26*c*. In this embodiment of the invention the sensed indicia 18 is employed by the controller 14 to select a corresponding one of the keys 26*b* and to thus read out an associated instruction or instructions of the selected cooking program 26*c* to the controller 14**.

For example, a cooking program **26*c* may have a single instruction that is a time (e.g. 3.5 min) that the controller 14 is to energize the cooking chamber. A cooking program 26*c* may be a time and a temperature (e.g. 120.0 min-350° ), or a time and power setting (e.g. 8.75 min-HIGH). A cooking program 26*c* can also include a plurality of instructions. For example, a $KEY_j$ can point to a cooking program 26*c*** having instructions of the format shown in Table 1.

TABLE 1

A) MESSAGE: "PLACE FROZEN PACKAGE CONTENTS IN MICROWAVE AND PRESS START"
B) * wait for start *
C) 24.0 min-LOW
D) MESSAGE : "DEFROST COMPLETED, TURN AND COVER"
E) * wait for start *
F) 60.0 min-HIGH
G) MESSAGE: "UNCOVER"
H) * wait for start *
I) 12.5 min-HIGH
J) * stop *
K) MESSAGE: "COOKING CYCLE COMPLETED"

In response to sensing an indicia 18 that corresponds to the $KEY_j$ the controller 14 accesses the memory 26 to determine if the cooking program **26*c* associated with the $KEY_j$ is present. If it is, the controller 14 reads in the associated cooking program 26*c***, as shown in Table 1, and interprets and executes the instructions in sequence. The text delimited by '*' indicates control points where a message is displayed or annunciated through the indicator 22 to the operator, the message typically requiring some operator action. The controller 14 pauses at the control point ('wait for start' sub-instruction) until the operator provides an input through switch 24.

For certain embodiments of this invention the restarting of the cooking program may be also conditioned upon an occurrence of some other event. By example, if the cooking chamber is a part of a microwave oven the controller will not energize the cooking chamber unless the 'door closed' indicator (one of signal lines **12*c***) is also asserted.

The key **26*b* may be identical to the entire indicia 18 or some portion thereof. The key 26*b* may also represent some unique or semi-unique encoding (e.g., CRC code) of the indicia 18. The exact format of the key 26*b* is not critical so long as it enables the associated cooking instruction 26*c*** to be accurately located.

As an example, the key **26*b* may be simply an address within the memory 26 where the cooking program 26*c* starts, or the key 26*b* may instead be an offset from some predetermined location. If the memory 26 is organized as a content addressable memory (CAM), the key 26*b* is applied to memory to return the associated cooking instruction 26*c***.

It may be desirable to encode, through a suitable data compression algorithm, either or both of the key **26*b* and the cooking instruction 26*c* to conserve the amount of storage locations that are required in the memory 26**.

It is also within the scope of this invention to encode the cooking variables, such as time(s), temperature(s), power setting(s) and the like into the indicia 18, and to also encode pointers to one or more messages within a stored set of messages. For example, the following sequence can be employed to represent the cooking program shown in Table 1:

M01*T24.0P1M07*T60.0P3M02*T12.5P3M19S DI, where T indicates that the following variable is a cooking time of format xxx.yy minutes, P indicates that the following variable is a power level code (1=low, 2=medium, 3=high), M indicates that the following two numeric characters are a message code that identify one of up to 100 prestored messages (shown stored in memory 26'), and S indicates stop. The '*' character is used to indicate a pause for user input (typically pressing the start button 24). The pause indicator can instead be imbedded in each message type that requires a pause, and is thus not required to be separately specified.

The ascii character stream shown above is encoded into a digital pattern suitable for detection by the detector 16 and interpretation by the controller 14. In response to receiving the digital pattern the controller 14 parses same and operates in a manner similar to a program interpreter to execute each instruction in turn. The sub-instructions shown in Table 1 are also parsed by the controller 14 and executed in an interpretive fashion.

In a further embodiment of this invention the text of the individual operator messages are also provided within the indica 18. For example, an indicia portion such as (Mxy) is replaced by (M: PLEASE CLOSE DOOR TO RESUME COOKING), or ('COOKING COMPLETED, PLEASE REMOVE AND SERVE'), or ("UNCOVER AND PRESS START (WATCH OUT FOR ESCAPING STEAM!)").

It should be appreciated that in this further embodiment the memory 26 or 26' is not required, in that all cooking instructions and messages are inputted through the sensor 16 and acted upon by the controller 14.

The portion 'DI' is employed as a data integrity portion which may be a parity bit, or a CRC code that provides the controller 14 with an ability to correct a single bit error and detect a multiple bit error in the input data stream. The use of the DI portion is preferred in that it guards against an inappropriate or erroneous cooking time, power level, or temperature being entered.

The particular cooking instruction messages are not required to be displayed to the operator in an alphanumeric format, but can instead be displayed as graphical patterns or icons of a type shown generally in FIGS. **2*a*–2*d*. The use of icons is advantageous when selling the cooking device 10** into a number of markets having differing language requirements.

In another embodiment of this invention the cooking device 10 also includes a full complement of operator controls, such as a keypad **28*a* and function keys 28*b* (power level, etc.), that enable conventional operator controlled cooking to be accomplished, either separate from or in combination with the use of the sensor 16 and indicia 18. The keypad 28*a* is also useful when for some reason the indicia 18 is unreadable by the sensor 16**, in that the operator is enabled to manually key-in the numeric equivalent.

It may be desirable in some embodiments of the invention to provide the memory 26 or 26' so that it can be removed and replaced. For example, manufacturers of prepared frozen foods can each offer a memory device or devices that contain the cooking instructions for their particular offerings. The user of the system 10 inserts the memory device, for example a "smart-card" -type device, into the system 10 prior to scanning the indicia 18.

The controller 14 can also be provided with a capability to program or reprogram a particular cooking program **26*c*. By example, an operator may key in a particular code through the keypad 28*a*, and then enter an entire cooking program for storage within the memory 26, or replace or update one or more particular cooking instructions of a cooking program. The specifics of this user interface may be as simple or as complex as required. For example, a user of the cooking device 10** may have a much simpler user interface than a retailer or a service person. The use a programmable memory device is preferred for this application, such as an electrically alterable read only memory.

It is also within the scope of this invention to record changes in a memory 27 that is separate from the memory 26, and to use the changes to alter or replace certain instructions when an associated cooking program **26*c*** is accessed for execution.

It can be appreciated that the use of this invention enables a manufacturer of food products to offer foods that have more complex cooking cycles than those normally offered. In that little or no operator intervention is required to program and operate the cooking device 10 a number of different power settings can be employed during the cooking cycle, as can cooking temperature variations (such as a gradual ramping up or down of the cooking temperature over time).

Furthermore, for a cooking device having a rotating platform (shown as 30 in FIG. 1) it can be appreciated that the controller 14 can initiate and terminate the rotation of the platform 30, and can also control the speed of rotation of the platform 30, all under the control of the cooking program that is identified by, or encoded within, the indicia 18.

Thus, while the invention has been particularly shown and described with respect to several exemplary embodiments thereof, it will be understood by those skilled in the art that changes in form and details may be made therein without departing from the scope and spirit of the invention.

What is claimed is:

1. A cooking device that comprises a cooking chamber having means for applying energy to a foodstuff within said cooking chamber, said cooking device further comprising:

control means having a first output coupled to said energy applying means for controlling an operation of said energy applying means;

a platform located within said cooking chamber, said platform having a surface for supporting a foodstuff during the application of energy to the foodstuff;

means coupled to said platform for rotating said platform about an axis of rotation that passes through said surface;

sensor means having an output coupled to a first input of said control means for inputting a signal to said control means that is representative of an indicia that is sensed by said sensor means; and memory means having an output coupled to a second input of said control means and an input coupled to a second output of said control means, said memory means storing at least a plurality of cooking programs; wherein said control means is responsive to said signal input from said sensor means for accessing said memory means to retrieve from said memory means a predetermined one of said cooking programs, said control means further being responsive to said accessed one of said predetermined cooking programs for outputting a first signal to said cooking chamber for controlling at least an operation of said energy applying means, and for outputting at least one second signal for controlling said rotating means to initiate the rotation of said platform and for also controlling said rotating means to set a speed of rotation of said platform.

2. A cooking device as set forth in claim 1 wherein said sensor means includes means for sensing a bar code.

3. A cooking device as set forth in claim 1 wherein said sensor means includes means for sensing a magnetic field.

4. A cooking device as set forth in claim 1 wherein said sensor means includes means for sensing printed alphanumeric characters.

5. A cooking device as set forth in claim 1 wherein said sensor means includes means for sensing a contrast between said indicia and a substrate upon which said indicia is recorded.

6. A cooking device as set forth in claim 1 wherein said predetermined one of said cooking programs includes at least one message portion, and further comprising means for displaying an information content of said at least one message portion to an operator of said apparatus.

7. A cooking device as set forth in claim 6 wherein said display means includes means for displaying alphanumeric characters.

8. A cooking device as set forth in claim 6 wherein said display means includes means for displaying at least one graphical image.

9. A cooking device as set forth in claim 1 and further comprising at least one switch means having an output coupled to a third input of said control means, wherein said control means is responsive to said output of said at least one switch means for initiating an execution of said predetermined one of said cooking programs upon receiving an enabling signal from said output of said switch means.

10. A cooking device as set forth in claim 1 and further comprising at least one switch means having an output coupled to a third input of said control means, wherein said predetermined one of said cooking programs includes an instruction the execution of which causes said control means to suspend the execution of further instructions, and wherein said control means is responsive to said output of said at least one switch means for continuing the execution of further instructions upon receiving an enabling signal from said output of said at least one switch means.

11. A cooking device as set forth in claim 1 wherein said signal output by said sensor means is encoded in a digital format, and wherein said digital format includes a data integrity portion.

12. A cooking device as set forth in claim 1 wherein said sensor means is responsive to a UPC barcode that is associated with a prepackaged food, and wherein said control means includes means for converting at least a portion of said UPC barcode into information that specifies said predetermined one of said cooking programs.

13. A cooking device that comprises a cooking chamber having means for applying energy to a foodstuff within said cooking chamber, said cooking device further comprising:

control means having a first output coupled to said energy applying means for controlling an operation of said energy applying means;

sensor means having an output coupled to a first input of said control means for inputting a signal to said control means that is representative of an indicia that is sensed by said sensor means;

display means having an input coupled to a second output of said control means; and memory means having an output coupled to a second input of said control means and an input coupled to a third output of said control means, said memory means storing at least a plurality of predetermined messages individual ones of which convey a cooking-related message to a user of said cooking device; wherein said control means is responsive to said signal input from said sensor means for outputting a signal to said cooking chamber for controlling at least an operation of said energy applying means, said control means further being responsive to said input signal for accessing said memory means to retrieve from said memory means one of said predetermined messages that is specified by a portion of said indicia, for temporarily de-energizing said energy applying means, and for displaying with said display means said specified one of said predetermined messages.

14. A cooking device as set forth in claim 13 wherein said sensor means includes means for sensing a bar code.

15. A cooking device as set forth in claim 13 wherein said sensor means includes means for sensing a magnetic field.

16. A cooking device as set forth in claim 13 wherein said sensor means includes means for sensing printed alphanumeric characters.

17. A cooking device as set forth in claim 13 wherein said sensor means includes means for sensing a contrast between said indicia and a substrate upon which said indicia is recorded.

18. A cooking device as set forth in claim 13 wherein said display means includes means for displaying alphanumeric characters.

19. A cooking device as set forth in claim 13 wherein said display means includes means for displaying at least one graphical image.

20. A cooking device as set forth in claim 13 and further comprising at least one switch means having an output coupled to a third input of said control means, wherein said control means is responsive to said output of said switch means for initiating the execution of said predetermined one of said cooking programs upon receiving an enabling signal from said output of said switch means.

21. A cooking device as set forth in claim 13 and further comprising at least one switch means having an output coupled to a third input of said control means, wherein said predetermined one of said cooking programs includes an instruction the execution of which causes said control means to suspend the execution of further instructions, and wherein said control means is responsive to said output of said switch means for continuing the execution of further instructions upon receiving an enabling signal from said output of said switch means.

22. A cooking device as set forth in claim 13 wherein said signal output by said sensor means is encoded in a digital format, and wherein said digital format includes a data integrity portion.

23. A cooking device as set forth in claim 13 wherein said sensor means is responsive to a UPC barcode that is associated with a prepackaged food, and wherein said control means includes means for converting at least a portion of said UPC barcode into information that specifies at least a duration of time that said cooking chamber is to be energized.

24. A cooking device that comprises a cooking chamber having means for applying energy to a foodstuff within said cooking chamber, said cooking device further comprising:

control means having a first output coupled to said energy applying means for controlling an operation of said energy applying means;

display means for presenting a cooking-related message to a user of said cooking device, said display means having an input coupled to a second output of said control means;

memory means having an output coupled to a first input of said control means and an input coupled to a third output of said control means, said memory means storing at least a plurality of predetermined cooking-related messages;

a platform located within said cooking chamber, said platform having a surface for supporting a foodstuff during the application of energy to the foodstuff;

means coupled to said platform for rotating said platform about an axis of rotation that passes through said surface, said rotating means having an input coupled to a fourth output of said control means;

sensor means having an output coupled to a second input of said control means for inputting a signal to said control means that is representative of an indicia that is sensed by said sensor means, said indicia specifying a sequence of cooking-related instructions including at least an amount of time that said energy applying means is to be energized, an identity of at least one of said predetermined messages that are stored in said memory means, at least one energy applying means termination code, and information specifying a rotational state of said platform means; wherein said control means is responsive to said signal input from said sensor means for parsing said sequence of cooking-related instructions that are represented by the indicia and for executing in turn individual ones of said sequence of cooking-related instructions, said control means being responsive to predetermined ones of said cooking-related instructions for outputting a signal to said cooking chamber for controlling a termination of operation of said energy applying means, for outputting a signal to said rotating means to at least initiate a rotation of said platform, for accessing a specified one of said predetermined cooking-related messages and for outputting said accessed one of said cooking-related messages to said display means for causing said accessed one of said cooking-related messages be presented to a user of said cooking device.

25. A cooking device as set forth in claim 24 wherein said sensor means includes means for sensing a bar code.

26. A cooking device as set forth in claim 24 wherein said sensor means includes means for sensing a magnetic field.

27. A cooking device as set forth in claim 24 wherein said sensor means includes means for sensing printed alphanumeric characters.

28. A cooking device as set forth in claim 24 wherein said sensor means includes means for sensing a contrast between said indicia and a substrate upon which said indicia is recorded.

29. A cooking device as set forth in claim 24 wherein said display means includes means for displaying alphanumeric characters.

30. A cooking device as set forth in claim 24 wherein said display means includes means for displaying at least one graphical image.

31. A cooking device as set forth in claim 24 and further comprising at least one switch means having an output coupled to a third input of said control means, wherein said control means is responsive to said output of said switch means for initiating an activation of said energy applying means upon receiving an enabling signal from said output of said switch means.

32. A cooking device as set forth in claim 24 wherein said signal output by said sensor means is encoded in a digital format, and wherein said digital format includes a data integrity portion.

33. A cooking device as set forth in claim 24 wherein said sensor means is responsive to a UPC barcode that is associated with a prepackaged food, and wherein said control means includes means for converting at least a portion of said UPC barcode into information that specifies at least a duration of time that said cooking chamber is to be energized.

34. A cooking device as set forth in claim 24 wherein said display means includes means for presenting said cooking-related message to a user as a graphical icon.

35. A cooking device as set forth in claim 24 wherein said memory means is removably coupled to said control means for being installed and uninstalled within said cooking device by a user of said cooking device.

* * * * *